US005232800A

United States Patent [19]

Pavlisko et al.

[11] Patent Number: 5,232,800

[45] Date of Patent: Aug. 3, 1993

[54] METHOD FOR IMPROVING CHARGE MOBILITY IN ELECTROPHOTOGRAPHIC PHOTORECEPTORS

[75] Inventors: Joseph A. Pavlisko, Pittsford; Louis J. Sorriero; Ralph H. Young, both of Rochester, all of N.Y.

[73] Assignee: Eastman Kodak Company, Rochester, N.Y.

[21] Appl. No.: 939,978

[22] Filed: Sep. 4, 1992

Related U.S. Application Data

[63] Continuation of Ser. No. 499,127, Mar. 26, 1990, abandoned.

[51] Int. Cl.[5] ..... G03G 15/02; G03G 5/00

[52] U.S. Cl. ..... 432/58; 430/96

[58] Field of Search ..... 430/58, 96

[56] References Cited

U.S. PATENT DOCUMENTS

| | | | |
|---|---|---|---|
| 3,615,414 | 10/1971 | Light | 430/75 X |
| 4,175,960 | 11/1979 | Berwick et al. . | |
| 4,908,289 | 3/1990 | Tanaka et al. | 430/73 |
| 5,028,502 | 7/1991 | Yuh et al. | 430/31 |
| 5,039,585 | 9/1991 | Rule et al. | 430/59 |

FOREIGN PATENT DOCUMENTS 63-256961 10/1988 Japan .

OTHER PUBLICATIONS

Duke et al., "Electron Transfer in Pendant-Group and Molecularly Doped Polymers", The American Physical Society, vol. 23, No. 5, Mar. 1981, pp. 2111-2125.

Sasakawa et al., "Effect of Polymer Matrices on Hole Transport of 1,2-trans-bis(9H-carbazole-9-yl) Cyclobutane Dissolved in a Polymer Binder", American Institute of Physics, 65 (7), Apr. 1, 1989, pp. 2750-2755.

Huoy-Jeh Yuh et al., "Charge Transport Processes in Molecularly Doped Polymers: Interaction Effect Between Charge Transporting Molecules and Polymers", presented at the Alamaden Symposium, San Jose, Calif., Oct. 15-18, 1989.

A. V. Vannikov et al., "Influence of the Medium Polarity on Electron Transport in Polymer Systems", Physica Status Solidi (a) 115, (1989), pp. K47-K51.

*Primary Examiner*—Marion E. McCamish
*Assistant Examiner*—Stephen C. Crossan
*Attorney, Agent, or Firm*—Dressler, Goldsmith, Shore, Sutker & Milnamow, Ltd.

[57] ABSTRACT

A method and composition for improving hole mobility in electrophotographic photoreceptors and other devices that comprises using certain polymers as binders.

4 Claims, No Drawings

METHOD FOR IMPROVING CHARGE MOBILITY IN ELECTROPHOTOGRAPHIC PHOTORECEPTORS

This application is a continuation of application Ser. No. 07/499,127, filed Mar. 26, 1990, now abandoned.

FIELD OF THE INVENTION

This invention relates to the use of certain photoconductive and charge-transporting compositions to improve charge mobility in electrophotographic photoreceptors.

BACKGROUND OF THE INVENTION

A photoreceptor for electrophotography consists of an electrically conductive support and, in contact with it, one or more layers which are insulating in the dark but become conductive upon exposure to image-forming radiation. In a typical process for forming an image, the surface of the photoreceptor is first electrostatically charged in the dark to a uniform initial surface potential and then exposed to image-forming radiation. In areas where the photoreceptor is irradiated, mobile charge carriers are generated and migrate so as to discharge the initial potential, whereas substantially no discharge occurs in unirradiated areas. The resulting imagewise pattern of surface potential can be developed into a visible image by application of a liquid or dry developer containing small, charged, black or colored toner particles. The image formed by the toner, can, if desired, be transferred to another surface, e.g., to paper.

A single-active-layer photoreceptor is one in which the generation of mobile charge by imaging light and its subsequent migration to effect a discharge occur in a single layer (the photoconductive layer). An example is Kodak Ektavolt Recording Film SO-102. An advantage of such a photoreceptor is the simplicity and economy of its fabrication. Usually, however, such a photoreceptor has a rather low sensitivity to image forming radiation.

A two-active-layer photoreceptor is one in which the generation of mobile charge by imaging light and its subsequent migration to effect a discharge occur in two distinct layers. One layer is responsible for the generation of mobile charge and the other provides a medium in which that charge can migrate. The former, termed the charge-generation layer (CGL), usually is relatively thin. The latter, termed the charge-transport layer (CTL), usually is relatively thick. Usually the CGL is sandwiched between the conductive support and the CTL. Other cases concerning the relative thicknesses and the relative positions are possible. For example, the CTL may be sandwiched between the conductive support and the CGL. In any case, the CGL and the CTL must be in intimate electrical contact. Two-active-layer photoreceptors frequently have advantageously high sensitivity to imaging radiation, smooth surfaces which can readily be cleansed of excess toner, good resistance to mechanical wear, and the ability to be used repeatedly to form a multiplicity of images. Typically they have the disadvantage of being relatively expensive to fabricate.

Photoreceptors can also be constructed with more than two electrically active layers. For example, U.S. Pat. No. 3,953,207 discloses a photoreceptor comprising, in order, a first CTL, a CGL, and a second CTL. A photoreceptor with two or more electrically active layers is termed a multi-active-layer photoreceptor.

In a single-active-layer photoreceptor, the photoconductive layer frequently comprises a monomeric charge-transporting compound, a polymeric binder and, optionally a monomeric sensitizing compound. The charge-transporting compound may be an aromatic amine or other nitrogen-containing organic compound capable of transporting positive charge carriers (holes), such as described in Columns 3–7 of U.S. Pat. No. 4,442,193 and Columns 4–5 of U.S. Pat. No. 4,666,802. Such hole-transporting compounds are often described as being "p-type photoconductors". The polymeric binder is typically of high molecular weight and otherwise chosen for (inter alia) high electrical resistivity and dielectric strength, good film-forming properties, solubility in organic solvents, and ability to act as a solid-state solvent for the monomeric components. Examples of polymeric binders are listed in Column 7 of U.S. Pat. No. 4,442,193. Various sensitizing compounds are known such as the naphthalene bis-dicarboximide compounds disclosed in U.S. Pat. No. 4,442,193 and the substituted pyrylium salts disclosed in U.S. Pat. Nos. 4,167,412 and 4,341,894. Instead of a monomerically dissolved sensitizing dye it is possible to use a finely divided inorganic, organometallic, or organic pigment dispersed through the photoconductive layer. In either case, the primary function of the sensitizing compound or the pigment is to provide for the generation of mobile charge in response to image-forming radiation.

A CTL in a two-active-layer photoreceptor often has a composition similar to that of the photoconductive layer of a single-active-layer photoreceptor, except that a CTL typically contains no sensitizing compound or dispersed pigment.

The CGL may contain an inorganic, organometallic, or organic pigment, either dispersed in a polymeric binder or present as a neat (i.e., monocomponent) layer. For examples, see U.S. Pat. No. 4,559,287, Column 6 and U.S. Pat. No. 4,346,158, Column 10. Alternatively it may contain an aggregate photoconductive composition as described in U.S. Pat. No. 4,175,960.

The concentration of a monomeric charge-transporting compound in a single-active-layer photoreceptor or in a CTL of a multi-active-layer photoreceptor can vary widely, from approximately 10 percent to about 60 percent of the dry weight of the layer. Generally, it is expected that the lower concentrations give better resistance of the photoreceptor against abrasion and a lower rate at which the photoreceptor, once charged, discharges in the dark (i.e., a lower "dark decay rate"). In addition, when the charge-transporting compound is relatively expensive, it is advantageous to use as little as is possible consistent with the requirements of a particular application. On the other hand, the lower concentrations also result in greatly reduced values of the mobility of charge carriers in the layer. Thus, a lower limit to the concentration is inevitably set at that point where the mobility is barely sufficient to accomplish a desired degree of discharge in a desired period of time. The mobility is defined as the drift velocity of charge carriers divided by the strength of the electric field. It typically depends on electric field strength, decreasing at lower field strengths. Roughly speaking, a mobility value around $1\times10^{-7}$ cm$^2$/V sec at a field strength of $5\times10^4$ V/cm is adequate for most electrophotographic processes, although certain process cycles may require greater values or tolerate lesser values.

On theoretical grounds, it has been stated that "Good electron- (hole) transport is achieved by utilizing . . . either rigid or nonpolar polymer matrices" [C. B. Duke and R. J. Meyer, Physical Review B, vol. 73, pp. 2111-2125 (1981)]. Standard polymeric binders (matrices) such as bisphenol A polycarbonate, however, are fairly rigid and only moderately polar, so it is not evident that binders that are yet more rigid or less polar should result in greatly improved mobility values. Moreover, published experimental data have not shown a significant dependence of the mobility on the binder. [See W. D. Gill, Proceedings of the Fifth International Conference on Amorphous and Liquid Semiconductors, edited by J. Stuke and W. Brenig (Wiley, New York, 1974, pp 901-907) and D. M. Pai et al., Philosophical Magazine B, vol. 48, pp. 505-522 (1983)].

The time required for a particular degree of discharge to occur is affected, not only by the mobility of the charge carriers but also by how rapidly they are injected from the CGL into the CTL. The term "delayed injection" refers to the condition in which the injection process requires a time comparable to, or greater than, the time required for charge carriers to cross the CTL. The presence and/or severity of delayed injection depends on the compositions of both the CGL and the CTL in a manner that is not understood in any detail.

In addition to photoreceptors for electrophotography, other devices that employ organic materials to transport holes (and the same or different organic materials to transport electrons) include photovoltaic cells (see U.S. Pat. No. 4,164,431) and electroluminescent devices (see U.S. Pat. Nos. 4,356,429 and 4,539,507). In each such device, for a given choice of charge-transporting compound, it is desirable to increase the mobility of the holes.

SUMMARY OF THE INVENTION

In accordance with the present invention, methods and compositions are provided for increasing the mobility of holes in single-active-layer photoreceptors and in the CTLs of multi-active-layer photoreceptors. The method comprises using certain polymers as binders for hole-transporting monomeric compounds. Consequently, it is possible to reduce the concentration of the hole-transporting monomeric compounds greatly while maintaining mobility values sufficient for any particular application. The method of the present invention can also be used to increase the mobility of holes in other devices such as photovoltaic cells or electroluminescent devices.

The present invention also relates to single-active-layer and multi-active-layer photoreceptors that comprise the polymeric binders of the present invention.

DETAILS OF THE PRESENT INVENTION

A first class of polymeric binders that is useful in the present invention comprises polymers composed entirely of carbon and hydrogen in which each monomeric unit contains at least one aryl moiety. Such polymers are typically prepared by the polymerization of hydrocarbon monomers that contain ethylenically unsaturated groups. Examples include polystyrene, poly(vinyltoluene)s, poly(alpha-methylstyrene), poly(4-t-butylstyrene), poly(vinylnaphthalene)s, and poly(4-vinylbiphenyl). These polymers are nearly nonpolar, by virtue of the absence of such heteroatoms as nitrogen, oxygen, halogen, or the like. This is the preferred class of binders for the practice of this invention. Within this class, polystyrene is presently preferred.

A second class of polymeric binders that is useful in this invention comprises polymers of the general structure

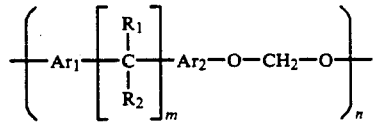

wherein:

$Ar_1$ and $Ar_2$, which can be the same or different, each represent an arylene group, either unsubstituted or having one or more hydrocarbon substituents;

$R_1$ and $R_2$, which can be the same or different, each represent a hydrogen or hydrocarbon substituent or together represent an unsubstituted or substituted cyclic hydrocarbon group or an unsubstituted or hydrocarbon-substituted alkylidene group;

m is 0 or 1; and n is at least 50.

One example of this class of polymers is poly(oxymethylenoxy-1,4-phenyleneisopropylidene-1,4-phenylene), wherein $Ar_1$ and $Ar_2$ are phenylene, $R_1$ and $R_2$ are methyl and m is 1. In other examples, $Ar_1$ and $Ar_2$ may be phenylene, naphthylene or the like, and $R_1$ and $R_2$ may each be methyl or may together be cyclopentylidene, cyclohexylidene, fluorenylidene, or the like.

A third class of polymeric binders that is useful in this invention comprises poly(phenyleneoxide) derivatives wherein the phenylene moiety is substituted in the 2 and 6 positions by hydrocarbon groups, each containing at least four carbon atoms. The currently preferred substituent is phenyl.

A fourth class of polymeric binders that is useful in this invention comprises poly(2-chlorostyrene) and poly(4-bromostyrene).

More particularly, the present invention is directed to a method of increasing the mobility of holes that comprises using the above-mentioned polymeric binders. The present invention is also directed to electrographic photoreceptors that comprise the above-mentioned polymeric binders, except polystyrene and compositions that contain a hole transporting monomeric compound and one of the above-mentioned polymers.

The method of this invention can be practiced with hole-transporting monomeric compounds of various classes. Examples include:

1. Carbazoles including carbazole, N-ethylcarbazole, N-isopropylcarbazole, N-phenylcarbazole, halogenated carbazoles, and the like;

2. Arylamines, including dialkylarylamines, alkyldiarylamines, and triarylamines. Specific hole-transporting triarylamine compounds include triphenylamine, tri-p-tolylamine, 1,1-bis(4-di-p-tolylaminophenyl)cyclohexane, tri-p-anisylamine; the nonpolymeric triphenylamines illustrated in U.S. Pat. No. 3,180,740; the triarylamines having at least one of the aryl radicals substituted by either a vinyl radical or a vinylene radical having at least one active hydrogen containing group, as described in U.S. Pat. No. 3,567,450; and the triarylamines in which at least one of the aryl radicals is substituted by an active hydrogen containing group, as described in U.S. Pat. No. 3,658,520;

3. Tetraarylbenzidines, such as tetra-p-tolylbenzidine, N,N'-diphenyl-N,N'-bis(3-methylphenyl)-[1,1'-biphenyl]-4,4'-diamine, and other tetraaryl benzidines described in U.S. Pat. Nos. 4,265,990, 4,047,949 and 4,346,158;

4. Polyarylalkanes of the type described in U.S. Pat. Nos. 3,274,000; 3,542,547; and 3,615,402. Included are hole-transporting compounds of the formula:

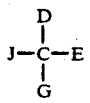

wherein D and G, which may be the same or different, represent aryl groups and J and E, which may be the same or different, represent a hydrogen atom, an alkyl group, or an aryl group, at least one of D, E, and G containing an amino substituent. An example is a polyarylalkane wherein J and E represent hydrogen, aryl or alkyl and D and G represent substituted aryl groups having as a substituent thereof a group of the formula:

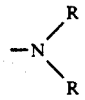

wherein R is unsubstituted aryl, such as phenyl, or alkyl-substituted aryl such as a tolyl group. Examples of such polyarylalkanes may be found in U.S. Pat. No. 4,127,412;

5. Hydrazones including the diphenyl hydrazones of dialkyl-substituted aminobenzaldehydes of U.S. Pat. No. 4,150,987; alkyl hydrazones and arylhydrazones as described in U.S. Pat. Nos. 4,544,231; 4,487,824; 4,481,271; 4,456,671; 4,446,271; and 4,423,129;

Preferred hole-transporting monomeric compounds are the triarylamines containing no heteroatom except for the triaryl substituted nitrogen. Especially preferred is tri-p-tolylamine.

The ratio of hole-transporting monomeric compound to polymeric binder can be chosen from a wide range, depending on the choice of hole-transporting monomeric compound, the choice of binder, and the value of the mobility that is required. Monomer:binder ratios of from about 5:95 to about 50:50 by weight may be used; ratios between about 10:90 and about 20:80 are presently preferred because they combine generally adequate values of mobility with the advantages of low concentrations of hole-transporting monomers. Frequently, a mobility of at least $1\times10^{-7}$ cm$^2$/V sec, substantially independent of the strength of the electric field, can be achieved when the hole-transporting monomeric compound and binder are present at a weight ratio of 10:90; and a mobility of at least $1\times10^{-4}$ cm$^2$/V sec, substantially independent of field strength, can be achieved at a weight ratio of 30:70. Higher mobility values can be achieved at higher weight ratios.

Various additives can be included in these compositions, such as sensitizing dyes or pigments, surfactants, leveling agents, plasticizers, adhesion promoters, or release agents, as are well known in the art. Best results are obtained with additives that are nonionic and have small or zero net dipole moments. The presence of an additive with a large dipole moment, e.g., exceeding about 2 Debye units, typically reduces the mobility relative to what would be obtained in its absence, to a degree that depends on the concentration of the additive.

If a sensitizing dye is used, the optimum concentration in any given case will vary with the specific hole transporting compound used and the degree of sensitization desired. In general, a sensitizer of the present invention may be used in a concentration ranging from about 0.01 to about 10 percent of the dry weight of the composition. Sensitizing compounds useful with the present composition can be selected from a wide variety of materials, including naphthalene-bis-carboximides; fluorenes, such as 7,12-dioxo-13-dibenzo(a,h)fluorene, 5,10-dioxo-4a,11-diazobenzo(b)-fluorene, 3,13-dioxo-7-diazodibenzo(b,g)-fluorene, and the like; aromatic nitro compounds of the kinds described in U.S. Pat. No. 2,610,120; anthrones like those disclosed in U.S. Pat. No. 2,670,284; quinones, U.S. Pat. No. 2,670,286; benzophenones, U.S. Pat. No. 2,670,287; thiazoles, U.S. Pat. No. 3,732,301; and various dyes, such as merocyanine, azine, anthraquinone dyes and the like and mixtures thereof. The sensitizing dyes preferred for use in the method of this invention are the naphthalene-bis-carboximides.

The thickness of the photoconductive layer in a single-active layer photoreceptor utilized in accordance with the present invention can vary widely but is generally in the range of from about 3 to about 100 microns. Preferably the thickness is in the range of from about 5 to about 30 microns.

The thickness of the active layers of a multi-active-layer photoreceptor utilized in accordance with the present invention can also vary widely. Generally, the CTL is of much greater thickness than the CGL. Typically, the CGL has a thickness in the range of from about 0.005 to about 10.0 microns, preferably in the range of from about 0.05 to about 2.0 microns. The CTL typically has a thickness in the range of from about 10 to about 35 microns.

Preferred CGLs are vacuum-vapor-deposited pigments such as bromoindium phthalocyanine; N,N'-bis(2-phenylethyl) perylene-3,4:9,10- bis(dicarboximide); 4,7,4',7'-tetrachlorothioindigo; amorphous selenium; a mixture of the isomeric compounds:

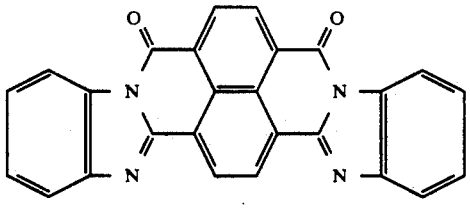

and

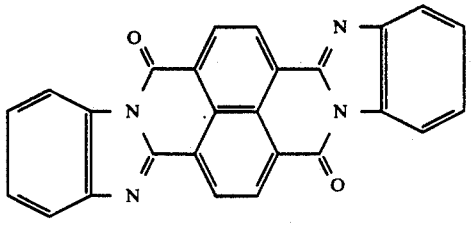

and a mixture of the isomeric compounds:

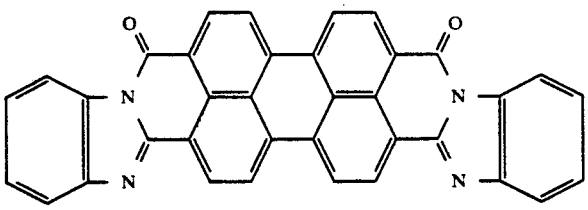

and

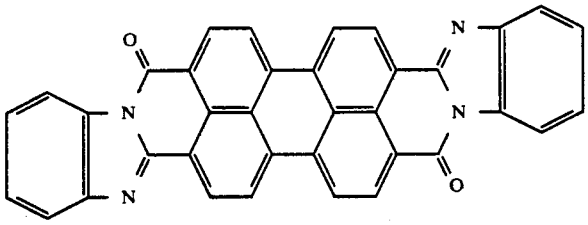

Most preferred is vacuum-vapor-deposited amorphous selenium.

The electrically conductive support may be either a substrate that is electrically conductive itself or a substrate that is coated with a conductive layer. The support can be fabricated in any suitable configuration, such as that of a sheet, a drum or an endless belt. Exemplary "electrically conductive supports" include paper (at a relative humidity above about 20 percent); aluminum-paper laminates; metal foils such as aluminum foil, zinc foil, etc.; metal plates or drums, such as aluminum, copper, zinc, brass and galvanized plates or drums; and metal layers such as nickel, aluminum, silver, chromium, vanadium, and the like coated on paper or conventional photographic film bases such as cellulose acetate, poly(ethylene terephthalate), polystyrene, etc. Such metals can be vacuum deposited on transparent film supports in sufficiently thin layers to allow electrophotographic photoreceptors prepared therewith to be exposed to radiation from either side of such elements. An especially useful conducting support can be prepared by coating a support material such as poly(ethylene terephthalate) with a conducting layer containing a semiconductor dispersed in a resin as described in U.S. Pat. No. 3,245,833. Other useful conducting layers include compositions consisting essentially of an intimate mixture of at least one inorganic oxide and from about 30 to about 70 percent by weight of at least one conducting metal, e.g., a vacuum-deposited cermet conducting layer described in U.S. Pat. No. 3,880,657. Likewise, a suitable conducting coating can be prepared from the sodium salt of a carboxyester lactone of a copolymer of maleic anhydride and vinyl acetate. Such kinds of conducting layers and methods for their optimum preparation and use are disclosed in U.S. Pat. Nos. 3,007,901 and 3,262,807.

In some cases, it is desirable to use one or more intermediate "subbing" layers over the electrically conductive material, to improve adhesion to it and/or to act as an electrical barrier layer between it and the other layers of the photoreceptor as described in U.S. Pat. No. 2,940,348. Such subbing layers, if used, typically have a dry thickness in the range of about 0.01 to about 5 microns. Typical subbing layer materials which may be used include film-forming polymers such as cellulose nitrate, polyesters, copolymers of vinyl pyrrolidone and vinylacetate, and various vinylidene chloride-containing polymers including two, three and four component polymers prepared from a polymerizable blend of monomers or prepolymers containing at least 60 percent by weight of vinylidene chloride. A partial list of representative vinylidene chloride-containing polymers including vinylidene chloride-methyl methacrylate-itaconic acid terpolymers is disclosed in U.S. Pat. No. 3,143,421. Various vinylidene chloride containing hydrosol tetrapolymers which may be used include tetrapolymers of vinylidene chloride, methyl acrylate, acrylonitrile, and acrylic acid as disclosed in U.S. Pat. No. 3,640,708. A partial listing of other useful vinylidene chloride-containing copolymers includes poly(vinylidene chloride-methyl acrylate), poly(vinylidene chloride-methyl methacrylate), poly(vinylidene chloride-methacrylonitrile), poly(vinylidene chloride-acrylonitrile), and poly(vinylidene chloride-acrylonitrile-methyl acrylate). Other useful subbing materials include the so-called tergels which are described in U.S. Pat. No. 3,501,301.

One especially useful subbing layer which may be employed in the photoreceptors of the invention is a hydrophobic film-forming polymer or copolymer free from any acid-containing group, such as a carboxylic acid group, prepared from a blend of monomers or prepolymers, each of said monomers or prepolymers containing one or more polymerizable ethylenically unsaturated groups. A partial listing of such useful materials includes many of the above-mentioned copolymers.

The invention will be illustrated by the following representative example.

EXAMPLE 1

To demonstrate the method of this invention and the improvements obtained therewith, the mobility of holes in various compositions was measured by the standard time-of-flight method.

A sample of each composition, typically 0.3 grams, was dissolved in dichloromethane to obtain a 10 weight percent solution. Each solution was coated onto a support/CGL using a doctor blade with a clearance of 75 to 125 microns, allowed to dry briefly in room air and for approximately 40 hours in blowing air at 40° C. The resulting coatings ranged from 4.7 to 16.0 microns in thickness. Multiple gold dots, approximately 5 mm in diameter and approximately 350 Angstroms thick were deposited on an approximately 10 $cm^2$ piece of each coating. The support/CGL consisted of a 100 or a 180 micron thick sheet of poly(ethylene terephthalate), on which were deposited, successively (a) a layer of nickel (optical density 0.4, estimated thickness between 150 and 200 Angstroms), (b) a subbing layer of poly[ethylene glycol/neopentyl glycol (55 moles/45 moles) terephthalate] of average thickness approximately 0.02 microns, and (c) a layer of amorphous selenium approximately 0.3 microns thick. The nickel and selenium were deposited by vacuum evaporation, the latter from selenium pellets (99.999% pure, supplied by Aldrich Chemical Company). The subbing layer was coated from an extrusion hopper using a 1.5 weight percent solution of the polymer in dichloromethane and dried at 19° C. for 40 sec. and at approximately 60° C. for 130 sec.

The nickel layer was connected to a high-voltage power supply via stripes of conductive carbon paste along the edges of the sample. Contact was made to a gold dot via an indium-coated phosphor-bronze tine; the dot was connected thereby through a current-sensing resistor to ground. Current passing through the sample produced a voltage across the resistor, which was amplified (PAR 113 Pre-Amp) and recorded by a transient digitizer (SONY/Tektronix 390 AD). Data from the digitizer were transferred to a computer for analysis.

The thickness of the layer of hole-transporting material was evaluated from the capacitance between one gold dot and the nickel electrode, assuming that the relative dielectric constant of that layer was 3.0.

Flash illumination was provided by (a) a flashlamp and a filter passing light of wavelength exceeding approximately 380 nm or (b) a nitrogen-pumped dye laser operating at 440 or 450 nm. Neutral-density filters were used to adjust the intensity of the light.

In the time-of-flight experiment, a voltage was applied by the power supply, and the flashlamp or laser irradiated the sample over a time short compared to the time required for holes to cross the sample (the transit time). The resulting photocurrent typically exhibited an early peak and rapid decline to a plateau, followed eventually by a shoulder and fall-off towards zero. The shoulder, defined by the crossing point of tangents to the plateau and the final fall-off, was identified as the transit time. [See, for example, J. X. Mack, L. B. Schein, and A. Peled, Physical Review B, vol. 39, pages 7500–7508 (1989), FIG. 3.] The velocity of the holes was computed as the thickness of the hole-transporting layer divided by the transit time. The mobility was computed as this velocity divided by the electric field strength.

In what follows, the following codes are used to identify exemplary hole-transporting monomeric compounds (A–F) and polymeric binders useful in the present invention. (1–14). Binder 0 is a polymeric binder that is commonly used in the art but is not useful in the present invention.

A. tri-p-tolyamine
B. 1,1-bis(4-di-p-tolylaminophenyl)cyclohexane
C. 4,4'-bis(diethylamino)-2,2'-dimethyltriphenylmethane
D. N,N,N',N'-tetra-p-tolyl-4,4'-diaminobiphenyl
E. p-diethylaminobenzaldehyde-diphenyl hydrazone
F. N-isopropylcarbazole, purified by recrystallization and zone refinement
0. Bisphenol A polycarbonate
1. polystyrene
2. poly(2-methylstyrene)
3. poly(4-methylstyrene)
4. poly(alpha-methylstyrene)
5. poly(p-tert-butylstyrene)
6. poly(1-vinylnaphthalene)
7. poly(2-vinylnaphthalene)
8. poly(4-vinylbiphenyl)
9. poly-2-chlorostyrene
10. poly-4-bromostyrene
11. poly(vinyltoluene, mixed isomers)
12. poly(2-vinyl naphthalene-co-vinyl toluene, mixed isomers)
13. poly(oxymethyleneoxy-1,4-phenylenisopropylidene-1,4-phenylene)
14. poly(2,6-diphenyl-p-phenylene oxide) Polymers 0, 1, 3–5, and 7–10 are available from Scientific Polymer Products in Ontario, N.Y. Polymer 6 is available from Polysciences, Inc. in Warrington, Pa. Polymer 2 was prepared by anionic polymerization. Polymers 11 and 12 were prepared by standard free-radical suspension techniques; the mixture of isomers of vinyltoluene was supplied by the Dow Chemical Company. A synthesis of polymer 13 is given by A. S. Hay et al., Polymer Preprints, vol. 23, pp. 117–118 (1982). Polymer 14 was synthesized by a known method similar to that described in D. M. White and H. J. Klopfer, Journal of Polymer Science, Part A-1, vol. 8, pp. 1427–1438 (1970).

The following table shows the mobility values obtained by the method of the present invention for various hole-transporting monomeric compounds. Included for comparison are mobility values obtained with binder 0, which are representative of the prior art.

| Hole transporting Monomer | | | | |
|---|---|---|---|---|
| code | proportion (wt. %) | Binder | Electric Field Strength (V/μm) | Mobility ($cm^2$/V sec) |
| A | 40 | 0 | 5 | $1.8 \times 10^{-5}$ |
| | | 1 | | $4.8 \times 10^{-4}$ |
| | 30 | 0 | 5 | $3.4 \times 10^{-6}$ |
| | | 1 | | $1.6 \times 10^{-4}$ |
| | | 6 | | $7.2 \times 10^{-5}$ |
| | | 0 | 10 | $4.3 \times 10^{-6}$ |
| | | 1 | | $1.6 \times 10^{-4}$ |
| | | 4 | | $2.3 \times 10^{-4}$ |
| | | 0 | 20 | $5.8 \times 10^{-6}$ |
| | | 1 | | $1.4 \times 10^{-4}$ |
| | | 2 | | $1.8 \times 10^{-4}$ |
| | | 3 | | $1.5 \times 10^{-4}$ |
| | | 5 | | $1.6 \times 10^{-4}$ |
| | | 8 | | $2.7 \times 10^{-5}$ |
| | | 13 | | $1.0 \times 10^{-4}$ |
| | 20 | 0 | 5 | $1.6 \times 10^{-7}$ |
| | | 1 | | $4.5 \times 10^{-5}$ |
| | | 8 | | $4.0 \times 10^{-6}$ |
| | | 9 | | $1.8 \times 10^{-6}$ |
| | | 10 | | $4. \times 10^{-7}$ |
| | | 12 | | $5.6 \times 10^{-6}$ |
| | | 14 | | $1.0 \times 10^{-5}$ |
| | | 0 | 20 | $2.6 \times 10^{-7}$ |
| | | 7 | | $2.5 \times 10^{-6}$ |
| | | 13 | | $5.6 \times 10^{-6}$ |
| | 15 | 0 | 20 | $3.6 \times 10^{-8}$ |
| | | 1 | | $3. \times 10^{-6}$ |
| | | 1 | 5 | $3. \times 10^{-7}$ |
| | | 11 | | $3. \times 10^{-7}$ |
| | | 13 | | $6.2 \times 10^{-8}$ |
| | | 14 | 20 | $1.1 \times 10^{-7}$ |
| B | 30 | 0 | 5 | $1.5 \times 10^{-6}$ |
| | | 1 | | $1. \times 10^{-4}$ |
| C | 30 | 0 | 5 | $3.4 \times 10^{-7}$ |
| | | 1 | | $8.4 \times 10^{-6}$ |

-continued

| Hole transporting Monomer code | proportion (wt. %) | Binder | Electric Field Strength (V/μm) | Mobility ($cm^2/V$ sec) |
|---|---|---|---|---|
| | 15 | 0 | 20 | $1.6 \times 10^{-8}$ |
| | | 1 | | $9.4 \times 10^{-7}$ |
| D | 30 | 0 | 5 | $1.7 \times 10^{-6}$ |
| | | 1 | | $2.5 \times 10^{-5}$ |
| E | 30 | 0 | 5 | $9.6 \times 10^{-8}$ |
| | | 1 | | $6.1 \times 10^{-7}$ |
| F | 20 | 0 | 20 | $4.7 \times 10^{-8}$ |
| | | 1 | | $3.9 \times 10^{-7}$ |

We claim:

1. An electrographic photoreceptor that comprises a polymeric binder selected from the group consisting of:

a) polymers of the formula:

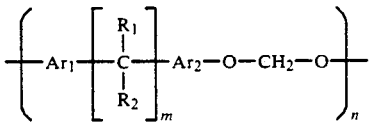

wherein $Ar_1$ and $Ar_2$ are arylene;

$R_1$ and $R_2$ are hydrogen or a hydrocarbon group, or together constitute an alkylidene group or cyclic hydrocarbon group;

m is 0 or 1; and n is at least 50; and b) poly(phenylene oxides) wherein the 2 and 6 positions are substituted with hydrocarbon groups that each contain at least four carbon atoms.

2. A composition that comprises a hole-transporting monomeric compound and a binder polymer selected from the group consisting of:

a) polymers of the formula:

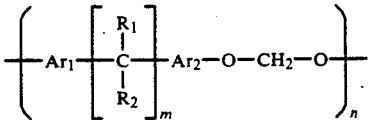

wherein $Ar_1$ and $Ar_2$ are arylene;

$R_1$ and $R_2$ are hydrogen or a hydrocarbon group, or together constitute an alkylidene group or cyclic hydrocarbon group;

m is 0 or 1; and n is at least 50; and b) poly(phenylene oxides) wherein the 2 and 6 positions are substituted with hydrocarbon groups that each contain at least four carbon atoms.

3. A single-active-layer photoreceptor that comprises a composition as in claim 2.

4. A multi-active-layer photoreceptor that comprises a composition as in claim 2.

* * * * *